US006273733B1

(12) United States Patent
Uchiyama

(10) Patent No.: US 6,273,733 B1
(45) Date of Patent: Aug. 14, 2001

(54) CONNECTING PART FOR AN IGNITION PLUG AND IGNITION CABLE

(75) Inventor: Takehito Uchiyama, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/437,138

(22) Filed: Nov. 10, 1999

(30) Foreign Application Priority Data

Nov. 12, 1998 (JP) ..... 10-321878

(51) Int. Cl.[7] ..... H01R 13/52

(52) U.S. Cl. ..... 439/125; 439/126; 439/127; 439/271

(58) Field of Search ..... 439/125, 126, 439/127, 128, 271, 272

(56) References Cited

U.S. PATENT DOCUMENTS

| | | | |
|---|---|---|---|
| 5,163,838 | 11/1992 | Tura, Jr. et al. | 439/126 |
| 5,348,486 | 9/1994 | Tura, Jr. et al. | 439/125 |
| 5,382,170 | 1/1995 | Imanichi | 439/127 |
| 5,476,695 | 12/1995 | Okada et al. | 428/1 |
| 5,492,105 | 2/1996 | Nakajima et al. | 123/625 |
| 5,547,387 | 8/1996 | Kobayashi | 439/125 |
| 5,632,636 | 5/1997 | Maekawa | 439/125 |
| 5,664,954 * | 9/1997 | Rea et al. | 439/125 |
| 5,878,706 * | 3/1999 | Akamatsu | 123/143 |
| 5,971,776 * | 10/1999 | Neel et al. | 439/125 |

FOREIGN PATENT DOCUMENTS 827165 3/1998 (EP) .

* cited by examiner

*Primary Examiner*—Gary Paumen
*Assistant Examiner*—Alexander Gilman
(74) *Attorney, Agent, or Firm*—Greenblum & Bernstein, P.L.C.

(57) ABSTRACT

There is provided a structure of a connecting part between an ignition plug and an ignition cable which makes it possible to make a connection between a connection terminal on the ignition cable and an end terminal on the ignition plug with more reliable security. A first elastomeric bushing is fitted into an upper end side of a plug tube formed of a ceramic material, and a second elastomeric bushing is fitted into the lower end of the plug tube. The portion of the ignition cable K near the high voltage terminal T is held by the first bushing so that the high voltage terminal is held at a predetermined position in the plug tube. Thus, when the second bushing is fitted over an insulator of the ignition plug, the high voltage terminal and the end terminal are secured in a positive electrically connected condition within the plug tube.

20 Claims, 7 Drawing Sheets

CONNECTING PART FOR AN IGNITION PLUG AND IGNITION CABLE

BACKGROUND OF THE INVENTION

1. Field of the Invention

The present invention relates to the construction of a connecting part, or connector, between the ignition plug and the ignition cable in an internal combustion engine, such as an automobile.

2. Description of Background Information

Depending on the layout of the internal combustion engine, such as an engine in an automobile, there may be times in which a heat generating member, e.g., an exhaust pipe or radiator, is positioned very close to the engine body. In fact, the heat which is generated in that area is often greater than 400° C. In such a cases, it is critical that the structure of the connection between the ignition cable and the ignition plug fixed to the engine body take into account the need to provide adequate countermeasures against such heat.

Accordingly, a conventional construction of the connecting part is shown in FIG. 6 and FIG. 7.

That is to say, the structure of the connecting part is such that a high voltage terminal T of the ignition cable K end is contained in a rubber boot 100. The rubber boot 100 is engaged with an insulator part Pg of an ignition plug P projecting from the engine body E, by which the high voltage terminal T and the end terminal Pt on the upper part of the insulator Pg are held in an electrically connected state. Additionally, the rubber boot 100 is covered with a metal heat shielding member 110, thereby preventing thermal degradation of the rubber boot 100.

Further, since a high voltage may be induced to the heat shielding member 110 by a secondary high voltage which provides the spark to the ignition plug P, the member 110 must be grounded. Therefore, the upper end of an electrically conductive coil spring 112 is engaged at the opening at the bottom end of the heat shielding member 110. The bottom end of the coil spring 112 projects downwardly from the heat shielding member 110, so that at the time of engagement of the rubber boot 100 with the insulator Pg, the coil spring 112 is brought into contact with the outer peripheral metal part 114 of the ignition plug P to provide the necessary ground.

However, according to the conventional construction of the connecting part as described above, in engaging the rubber boot 100 with the insulator Pg, the coil spring 112 interferes with the insulator Pg of the ignition plug P. Accordingly, the assembly process is inhibited, and due to the insufficient engagement between the rubber boot 100 and the insulator Pg, electrical connection between the high voltage terminal T and the end terminal Pt becomes imperfect, thus giving rise to a risk of inducing accidental firing of the ignition plug or stoppage of the engine.

Also, because of the configuration of the outside of the rubber boot 100 to be covered by the heat shielding member 110, the construction of the connecting part must be greater in size. This leads to aggravation of assembly work in a narrow space surrounded by exhaust pipes and the like, and to an imperfect electrical connection between the high voltage terminal T and the end terminal Pt caused by incomplete engagement between the rubber boot 100 and the insulator Pg, which may result in accidental firing of the ignition plug or stoppage of the engine.

Furthermore, according to the construction of the connecting part as above, by pressing downwardly on the upper end of the rubber boot 100, the rubber boot 100 is to be engaged with the insulator part Pg. However, since the rubber boot per se has low rigidity, and since it is surrounded by a metal heat shielding member 110, no moderate feel is provided at the time of the engagement. Therefore, assembly is apt to be terminated prior to complete engagement between the rubber boot 100 and the insulator part Pg. Thus, the resulting incomplete electrical connection between the high voltage terminal T and the end terminal Pt gives rise to a risk that the engine will be accidentally fired or stopped.

Accordingly, the present invention has been made to resolve the problems described above, and its object is to provide a construction of the connecting part between the ignition plug and the ignition cable so that it is possible to provide a more secure connection between the connection terminal on the ignition cable side.

SUMMARY OF THE INVENTION

In order to solve the problems as set forth above, a first aspect of the present invention includes a structure for the connection between an ignition plug mounted to the engine body, the ignition plug having an insulator and a terminal projecting from the upper end thereof, and an ignition cable having a high voltage terminal mounted at one end. A ceramic tube is provided having a generally tubular configuration in which the high voltage terminal at the end of the ignition cable can be accommodated. The high voltage terminal is inserted to a predetermined position inside a first end of the plug tube through a first bushing, and a second bushing is provided at a second end. The high voltage terminal and the end terminal are electrically connected in the plug tube by fitting the second bushing over the insulator, and the high voltage terminal is held at a predetermined position in the plug tube by engagement with the first bushing.

In a second aspect of the present invention, the plug tube may be configured to include a projection on the inner peripheral surface of the second end of the plug tube, and a groove for engagement with the projection is formed on the second bushing, so that when the second bushing is inserted into the second end of the plug tube, the projection is engaged with the groove.

Furthermore, according to a third aspect of the present invention, the second bushing may be formed with a configuration and size as to be accommodated within the second end of the plug tube.

In another aspect of the present invention, a connector is provided for connecting an ignition cable to an ignition plug, the ignition plug being mounted to project from an engine body, the plug having an insulator and an end terminal disposed at an upper end of the plug, and the ignition cable having a high voltage terminal at one end thereof. The connector includes a plug tube formed of a ceramic material and having a generally tubular configuration in which a high voltage terminal at the end of the ignition cable can be accommodated, with first and second bushings inserted within first and second ends of the plug tube, respectively. The high voltage terminal is receivable within the plug tube with the first bushing fixedly holding the ignition cable so that the high voltage terminal is located at a predetermined position in the plug tube to engage the end terminal of the ignition plug, and the high voltage terminal and the end terminal are electrically connectable within the plug tube by fitting the second bushing over the insulator such that the high voltage terminal engages the end terminal.

According to a further aspect of the present invention, a connector is provided for connecting an ignition cable to an ignition plug, the ignition plug being mounted to an engine body and having an insulator and an end terminal disposed at an upper end thereof projecting from the engine, and the ignition cable having a high voltage terminal at one end thereof. The connector includes a plug tube formed of an electrically insulating, high heat resistant material and having a generally tubular configuration in which a high voltage terminal at the end of the ignition cable can be accommodated, and first and second bushings are inserted within first and second ends of plug tube, respectively. The high voltage terminal is receivable within the plug tube with the first bushing fixedly holding the ignition cable so that the high voltage terminal is located at a predetermined position in the plug tube to engage the end terminal of the ignition plug, and the high voltage terminal and the end terminal are electrically connectable within the plug tube by fitting the second bushing over the insulator such that the high voltage terminal engages the end terminal. Additionally, the insulating material of the plug tube may include a material having thermal insulating properties to insulate against temperatures above 1000° C., and the insulating material may include a ceramic material.

In another aspect of the present invention, the second end of the plug tube includes a radially inwardly extending peripheral rib, and the second bushing includes a radially outwardly extending peripheral groove to engage with the rib. The second bushing is inserted into the second end of the plug tube so that the rib engages within the groove.

In other aspects of the present invention, the second bushing may be configured so that the second bushing is accommodated entirely within the second end of the plug tube. Additionally, the second end of the plug tube may include an outer cylindrical portion forming an axially extending annular groove, and the second bushing may include an axially extending in-turned peripheral flange that interfits within the annular groove. Additionally, the outer cylindrical portion may extend to a position past an outermost end of the second end of the plug tube to cover and protect the second bushing.

Alternatively, the second bushing may include a radially outwardly extending peripheral flange that engages an outermost end of the second end of the plug tube.

In a further aspect of the present invention, the second end of the plug tube may include a radially outwardly extending peripheral rib, and the second bushing may include an axially extending internal flange having a radially inwardly extending peripheral groove that interfits with the peripheral rib.

Alternatively, an axially outermost end of the second bushing may coterminate with an axially outermost end of the second end of the plug tube.

In a further aspect of the present invention, at least one of the first and second ends of the plug tube may include a radially enlarged portion that receives a respective one of the first and second bushings. Additionally, both the first and second ends of the plug tube may include the radially enlarged portions. Moreover, in another aspect of the invention, a system is provided including the ignition plug and the ignition cable, in addition to the connector described above.

BRIEF DESCRIPTION OF THE DRAWINGS

The invention will be described below in detail with reference to the accompanying drawings in which similar elements are indicated by similar reference numerals, and wherein.

DETAILED DESCRIPTION OF THE PRESENT INVENTION

The construction of the connecting part between the ignition plug and the ignition cable according to a preferred embodiment of the present invention will now be described with reference to the drawings.

Figure 1:
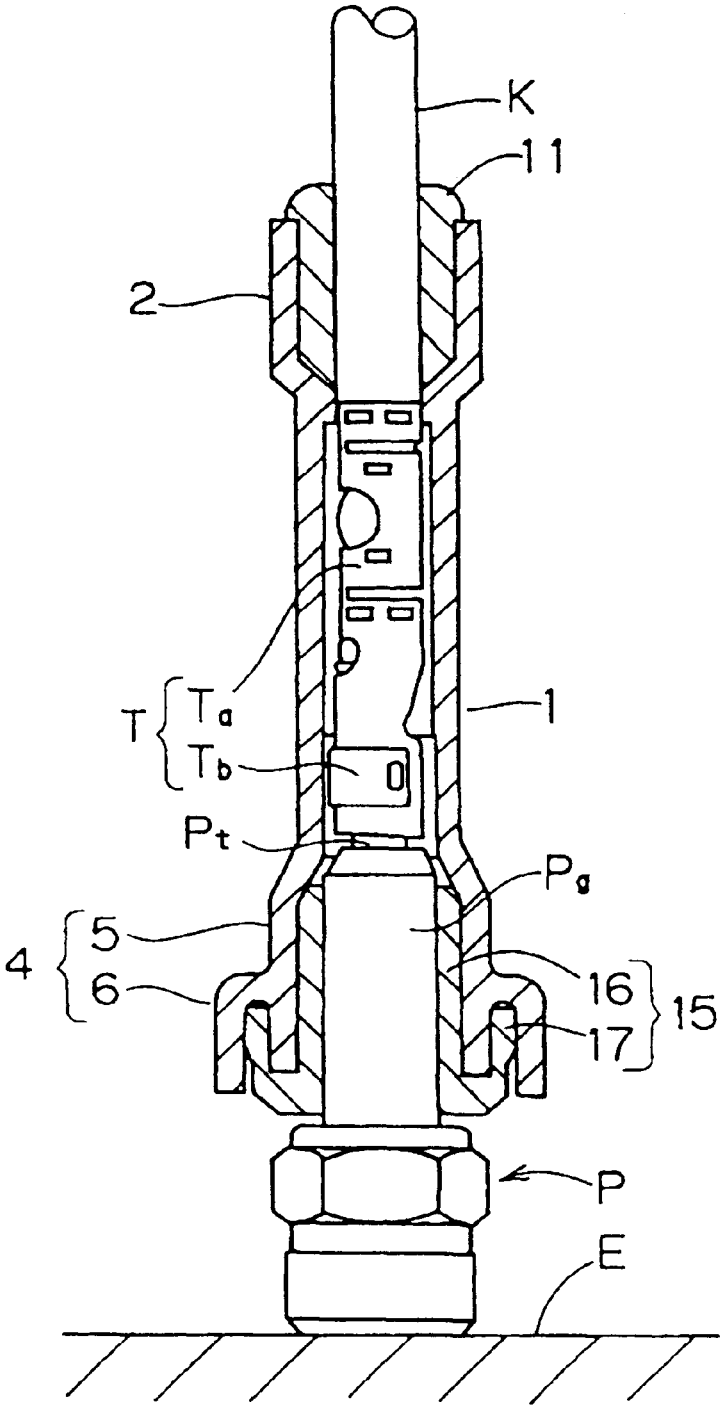
FIG. 1 is a sectional view showing a construction of a connecting part between an ignition plug and an ignition cable in an embodiment of the present invention.

The construction of the connecting part, or connector, according to the first embodiment of the present invention is shown in FIG. 1, in which the ignition cable K provided at the end with a high voltage terminal T is connected to an ignition plug P fixed to the engine body E of internal combustion engine or the like for automobile.

The ignition plug P is fixed to the engine body E such that the insulator Pg on the upper part thereof projects from the outer surface of the engine body E. An end terminal Pt projects from the upper end of the insulator Pg for application of high voltage. A high voltage terminal T is fixed to the end of the ignition cable K through a press-fit holding part Ta thereof, and an end terminal Tb for engagement with end terminal Pt is sequentially connected to the press-fit holder Ta. By engagement of the end terminal Pt in the terminal Tb, electrical connection between the ignition cable and the ignition plug P is made.

A plug tube 1 is formed of an electrically non-conductive ceramic material having excellent (high) heat resistance and has a generally cylindrical configuration. By high heat resistance, it is meant that the material has a heat resistance to temperatures of more than 1,000° C. Here, one example of such a material is a ceramic material comprising an alumina type having a heat resistance temperature of more than 1,000° C. However, any suitable electrically non-conductive insulating ceramic material, or other material, having a high heat resistance can be used.

The upper end of the plug tube 1 has a diameter slightly larger than that of the intermediate part in the longitudinal direction and is formed into a first fitting part 2. A first bushing 11 is inserted into the first fitting part 2. The first bushing 11 is formed to have the shape of a short tube, and is formed of an elastic material, such as rubber. However, any suitable elastic material may be used. The first bushing 11 holds the part of the ignition cable K near the high voltage terminal T which is inserted into the first bushing 11, so that the high voltage terminal T is held at a predetermined position of the intermediate part in the longitudinal direction of the plug tube 1. Furthermore, the upper end of the plug tube 1 is sealed and insulated by the first bushing 11, thereby preventing leakage of current along the inner peripheral surface of the plug tube 1 from the terminal Pt and high voltage terminal T.

The lower end part 5 of the plug tube 1 has a diameter slightly larger than that of the intermediate part in the longitudinal direction, and an outer cylindrical portion 6 forms an axially extending annular groove and is provided in a manner to cover the outer peripheral surface of the part 5 and extends a predetermined distance lower than the intermediate position in the upper and lower direction of the outer peripheral surface of the part 5, by which there is formed a second fitting portion 4 to which a second bushing 15 can be fitted. The second bushing 15 is formed of an elastic material such as rubber, and is provided with a tubular body 16 which is to be fitted into the part 5, although second bushing 15 may be formed from any suitable elastic material. The second bushing 15 also includes a generally cylindrical in-turned flange 17 formed continuously upward externally from the lower end of the body 16. The body 16 is fitted into the part 5 and the in-turned flange 17 is accommodated in the annular groove between the part 5 and an outer cylindrical portion 6, by which the second bushing 15 is mounted to the second fitting portion 4. The body 16 is configured to be fitted over the insulator Pg of the ignition plug P. When the body 16 is fitted over the upper part of the insulator Pg, the end terminal Pt on the upper end of the insulator Pg is engaged in the terminal Tb of the high voltage terminal T, with the result that the terminal Pt and high voltage terminal T are electrically and mechanically connected. At the same time, the lower end of the plug tube 1 is sealed and insulated by the second bushing 15, thereby preventing leakage of current which runs along the inner peripheral surface of the plug tube 1 from the high voltage terminal T and the end terminal Pt.

Next, the method for assembling the structure of the connecting part between the ignition plug and the ignition cable will be described.

First, an ignition cable K which has no high voltage terminal T at its end is inserted through the first bushing 11, and then the ignition cable K is inserted through the plug tube 1 from the top end thereof. The inserted end of the ignition cable K is drawn out from the lower end of the plug tube 1, and a high voltage terminal is press-fitted thereon. Then, the first bushing 11 is fitted into the first fitting part 2, after which the ignition cable K is pulled back toward the upper end of the plug tube 1 to a predetermined position such that the high voltage terminal T is held in the predetermined position in the plug tube 1. Thereafter, the second bushing 15 is fitted to the second fitting part 4, and the body 16 of the second bushing 15 is positioned over to the insulator part Pg of the ignition plug P fitted to the engine body E so that the high voltage terminal T and the end terminal Pt are electrically connected within the plug tube 1.

According to the structure of the connecting part between the ignition plug and the ignition cable configured in the above manner, firstly, the portion near the high voltage terminal T of the ignition cable K is held by the first bushing 11 so that the high voltage terminal T is held in a predetermined position within the plug tube 1, so that when the second bushing 15 fitted to the second fitting part 4 of the plug tube 1 is positioned over the insulator Pg, the high voltage terminal T and the end terminal Pt are electrically connected within the plug tube 1. At this time, the upper end and the lower end of the plug tube 1 are respectively sealed for insulation by the first bushing 11 and the second bushing 15.

Figure 6:
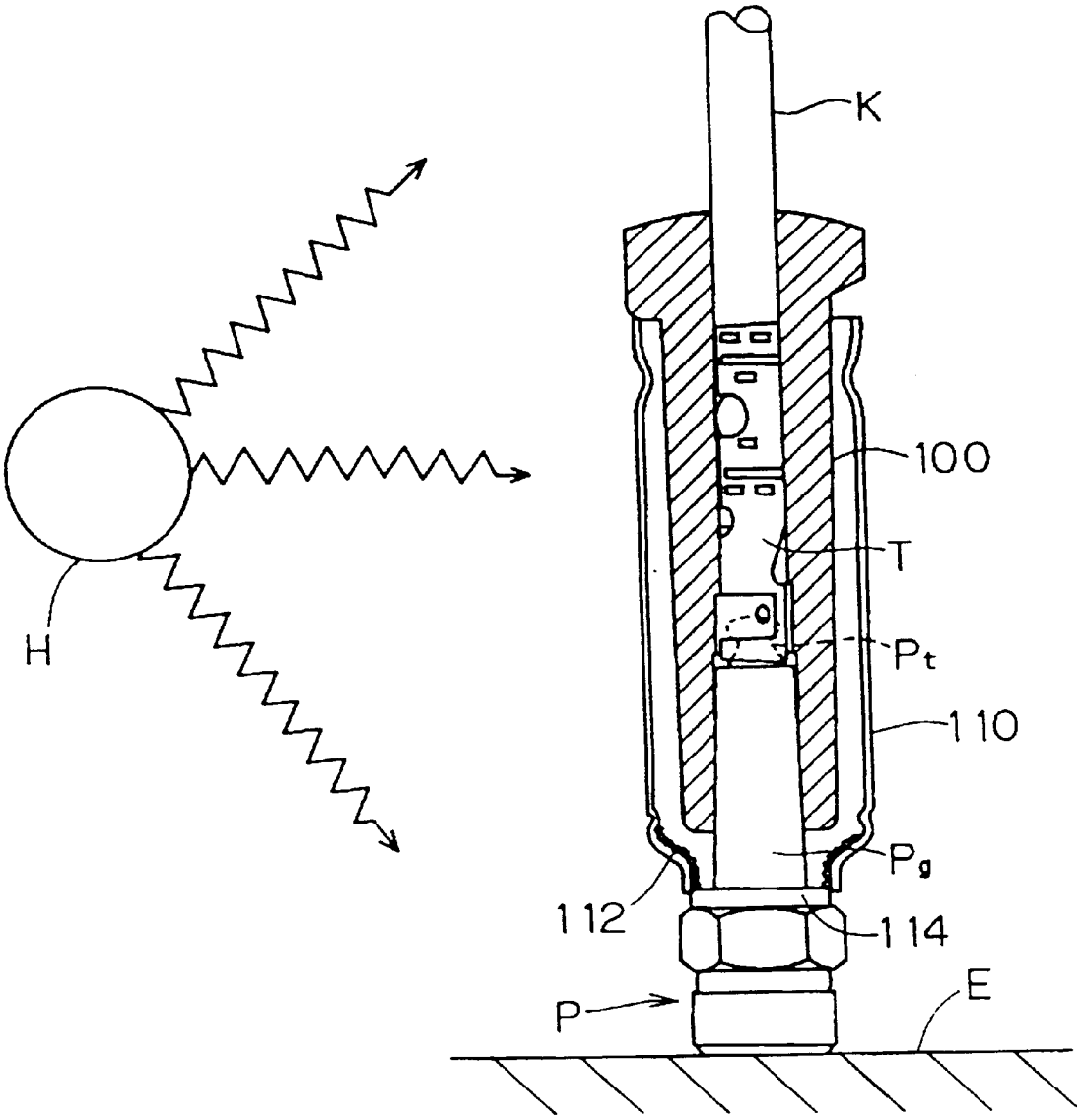
Fig. 6 (PRIOR ART)
FIG. 6 is a sectional view showing a structure of conventional connecting part between an ignition plug and an ignition cable.
Figure 7:
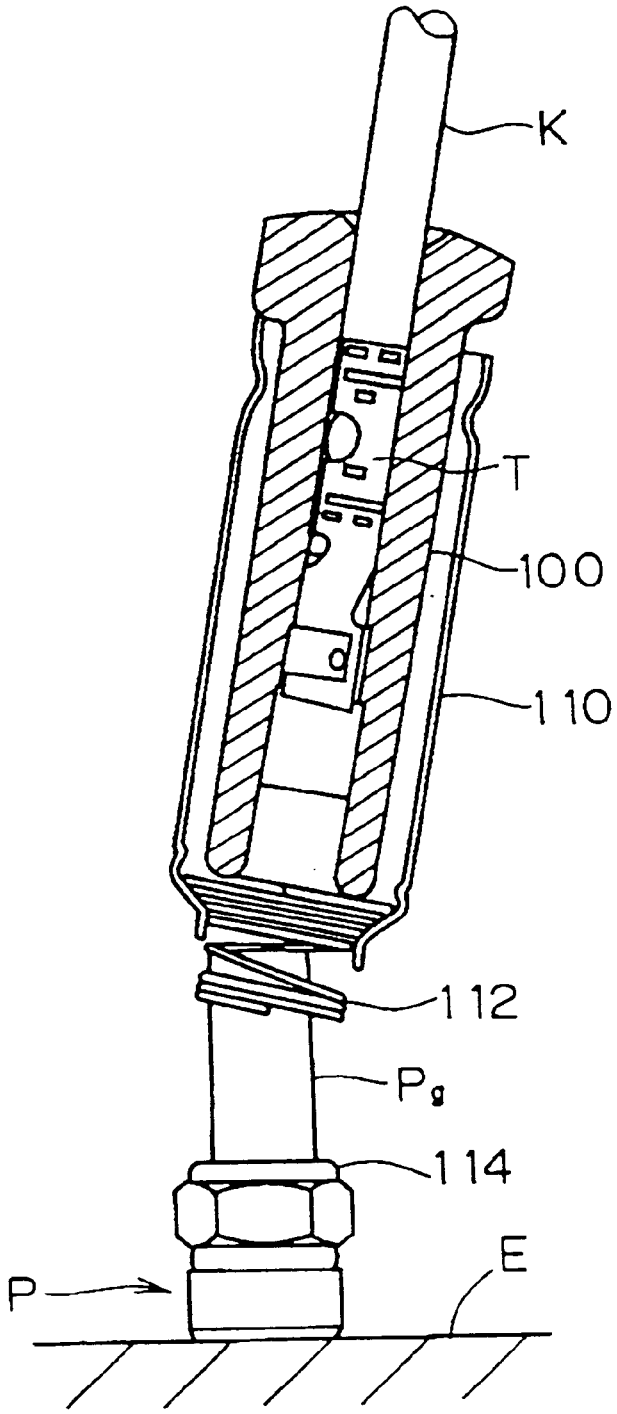
Fig. 7 (PRIOR ART)
FIG. 7 is a sectional view showing an assembly step of the above connecting part.

And, as the plug tube 1 is a ceramic material having high heat resistance unlike the conventional structure shown in FIG. 6 and FIG. 7, there is no necessity to provide an additional heat shielding member 110, and it can be expected to configure the structure of the connecting part of the present invention to be compact in size. This permits easy and efficient assembly in a narrow space surrounded by an exhaust tube and other related vehicle structure, thus assuring more perfect electrical connection between the high voltage terminal T and the terminal Pt.

Furthermore, because the plug tube 1 of the present invention is formed of an electrically non-conductive ceramic material, there is no need to ground the plug tube 1. Accordingly, in comparison to the conventional construction in which the coil spring 112 for grounding is an indispensable component and which coil spring 112 inhibits a positive electrical connection between the high voltage terminal T and the end terminal Pt, the present invention, which does not necessitate such a coil spring exhibits less likelihood for the situation described above to occur, which assures a more positive electrical connection between the high voltage terminal T and the end terminal Pt.

Furthermore, since the plug tube 1 is formed of a high hardness ceramic material, in positioning the second bushing 15, which is fitted to the lower end of the plug tube 1, over the insulator part of the ignition plug P, moderate feel of their engagement can be improved. Thus, the structure of the connecting part can be configured so that sufficient engagement between the second bushing 15 and the insulator Pg is made. In this respect, electrical connection between the high voltage terminal T and the end terminal Pt is more satisfactorily attained.

Since the construction of the present embodiment is such that the first bushing 11 is fitted within the fitting part 2 at the upper end of the plug tube 1, the body 16 of the second bushing 15 is fitted within the enlarged diameter part 5 of the plug tube 1, and further the in-turned flange 17 of the second bushing 15 is accommodated within the outer tubular part 6, the portions of the first bushing 11 and second bushing 15 covered by the plug tube 1 are prevented from being exposed to radiating heat, and accordingly thermal degradation of the first bushing 11 and second bushing 15 is prevented.

Furthermore, because the body 16 of the second bushing 15 is fitted within the enlarged diameter part 5 of the plug tube 1, and the in-turned flange 17 of the bushing 15 is accommodated within the outer tubular part 6, leakage of electricity externally downward along the inner peripheral surface of the plug tube 1 from the high voltage terminal T and end terminal Pt is more reliably prevented. Additionally, since the second bushing 15 is securely fitted to the plug tube 1, for example, disengagement of the second bushing 15 from the plug tube 1 during removal of the plug tube 1 from the ignition plug P can be prevented.

Hereinafter, various modifications of the foregoing embodiment will be described. In the explanations on these modifications, corresponding elements that are the same as those of the above embodiment are indicated with like reference numerals, and explanations of the same are omitted.

Figure 2:
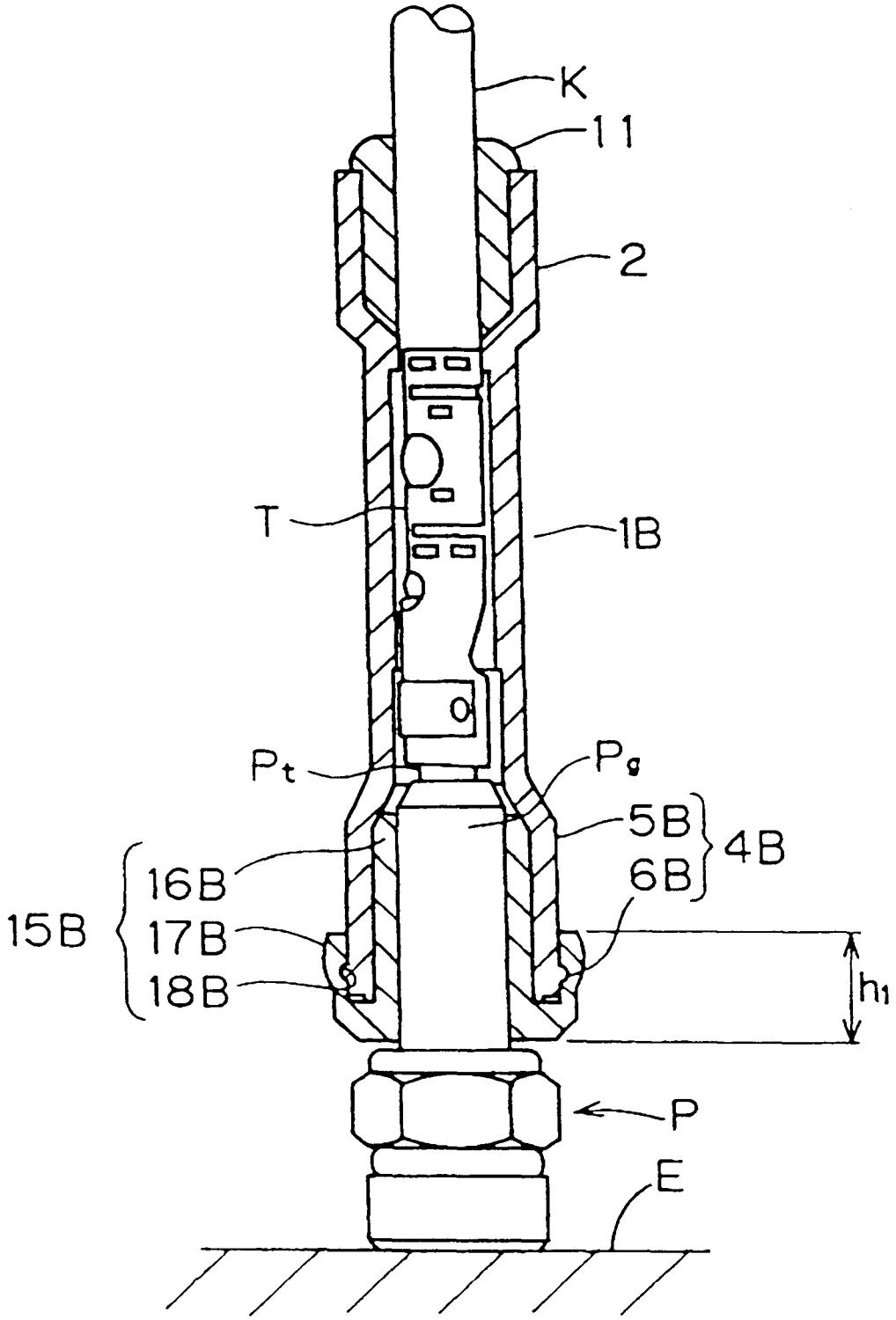
FIG. 2 is a sectional view showing a first modified embodiment of the above connecting part.

The first modified embodiment is configured, as shown in FIG. 2, with the lower end of the plug tube 1B provided with a slightly larger diameter than the intermediate part in its longitudinal direction. The lower part of the outer peripheral surface of the enlarged diameter part 5B is provided with a projecting rib 6B around the entire periphery in the circumferential direction thereof, thereby forming a second fitting part 4B. Furthermore, the second bushing 15B to be fitted to the second fitting part 4B is provided with a tubular body 16B to be inserted in the enlarged diameter part 5B, and a generally tubular in-turned flange 17B is continuously formed along the outer peripheral surface of the enlarged diameter part 5B to extend upwardly from the lower end of the body 16B. The inner peripheral surface of the in-turned flange 17B is formed with a groove 18B into which the projecting rib 6B can be engaged throughout the entire periphery thereof. By inserting the body 16B into the enlarged diameter part 5B and engaging the projecting rib 6B with the groove 18B in a manner to have the in-turned flange 17B cover the outer peripheral surface of the enlarged diameter part 5B, the second bushing 15B is firmly secured to the second fitting part 4B.

In this case, it is desirable from the point of preventing thermal deterioration to make the part of the second bushing 15B which is exposed outside the plug tube 1B as small as possible. Accordingly, it is desirable to make the length h, of the in-turned flange 17B as small as possible.

In this first modified embodiment, beneficial results can be obtained, in that the in-turned flange 17B is configured to cover the outer peripheral surface of the enlarged diameter part 5B, leakage of electricity externally downward along the inner peripheral surface of the plug tube 1 from the high voltage terminal T and terminal Pt is more reliably prevented. Furthermore, due to the engagement of the projecting rib 6*b* with the groove 18B, for example, disengagement of the second bushing 15B from the plug tube 1B during removal of the plug tube 1B from the ignition plug P can be prevented.

Figure 3:
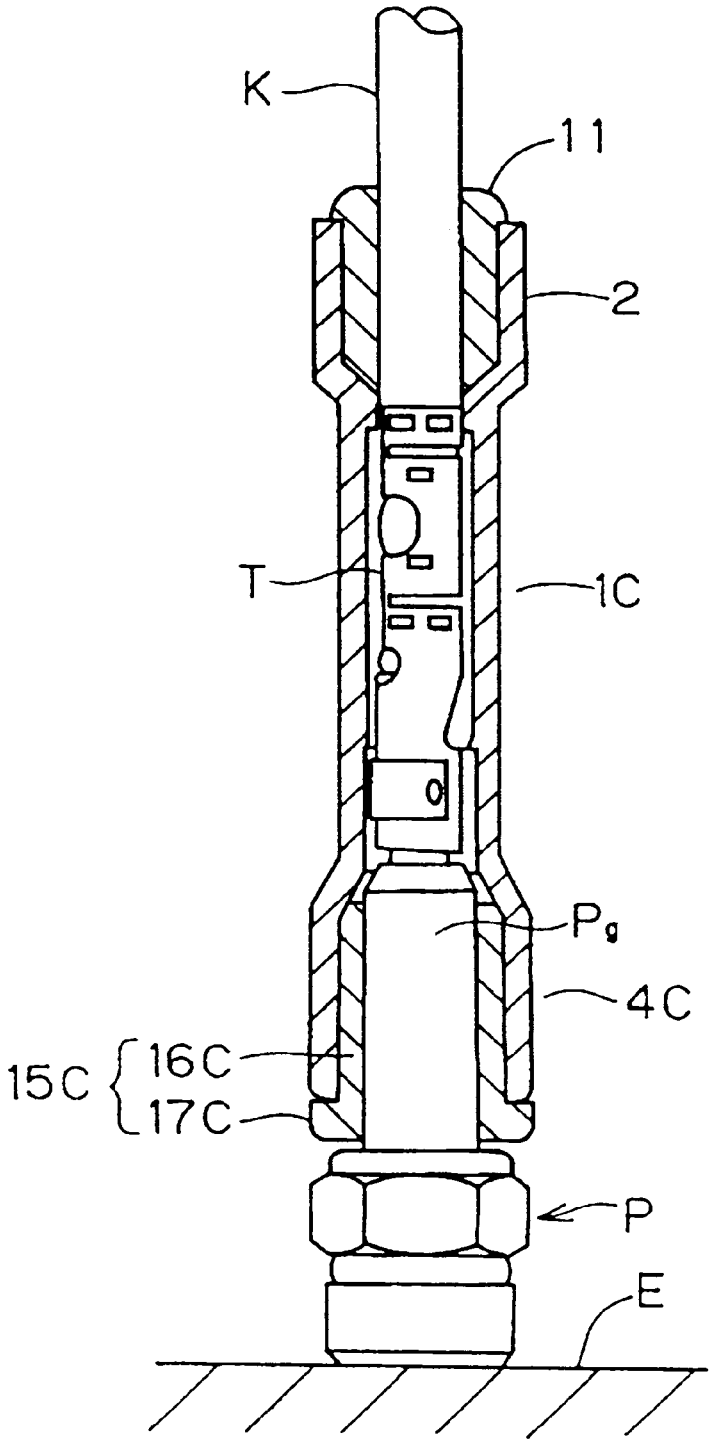
FIG. 3 is a sectional view showing a second modified embodiment of the above connecting part.

Next, referring to the second modified embodiment, as shown in FIG. 3, the lower end of the plug tube 1C is provided with slightly larger diameter than that of the intermediate part in its longitudinal direction to form the second fitting part 4C. On the other hand, the second bushing 15C to be fitted into the second fitting part 4C is formed with a projecting flange 17C which projects outwardly about the entire periphery on the lower end of the outer peripheral surface of the body 16C. Thus, by inserting the body 16C into the second fitting part 4C until the flange 17C comes into direct contact with the lower end face of the second fitting part 4C, the second bushing 15C is fitted to the second fitting part 4C.

In this second modified embodiment, since the only exposed portion of the second bushing 15C is the portion of the flange 17C, and as the flange 17C is relatively small, the bushing 15C becomes less likely to be thermally deteriorated by radiated heat.

Figure 4:
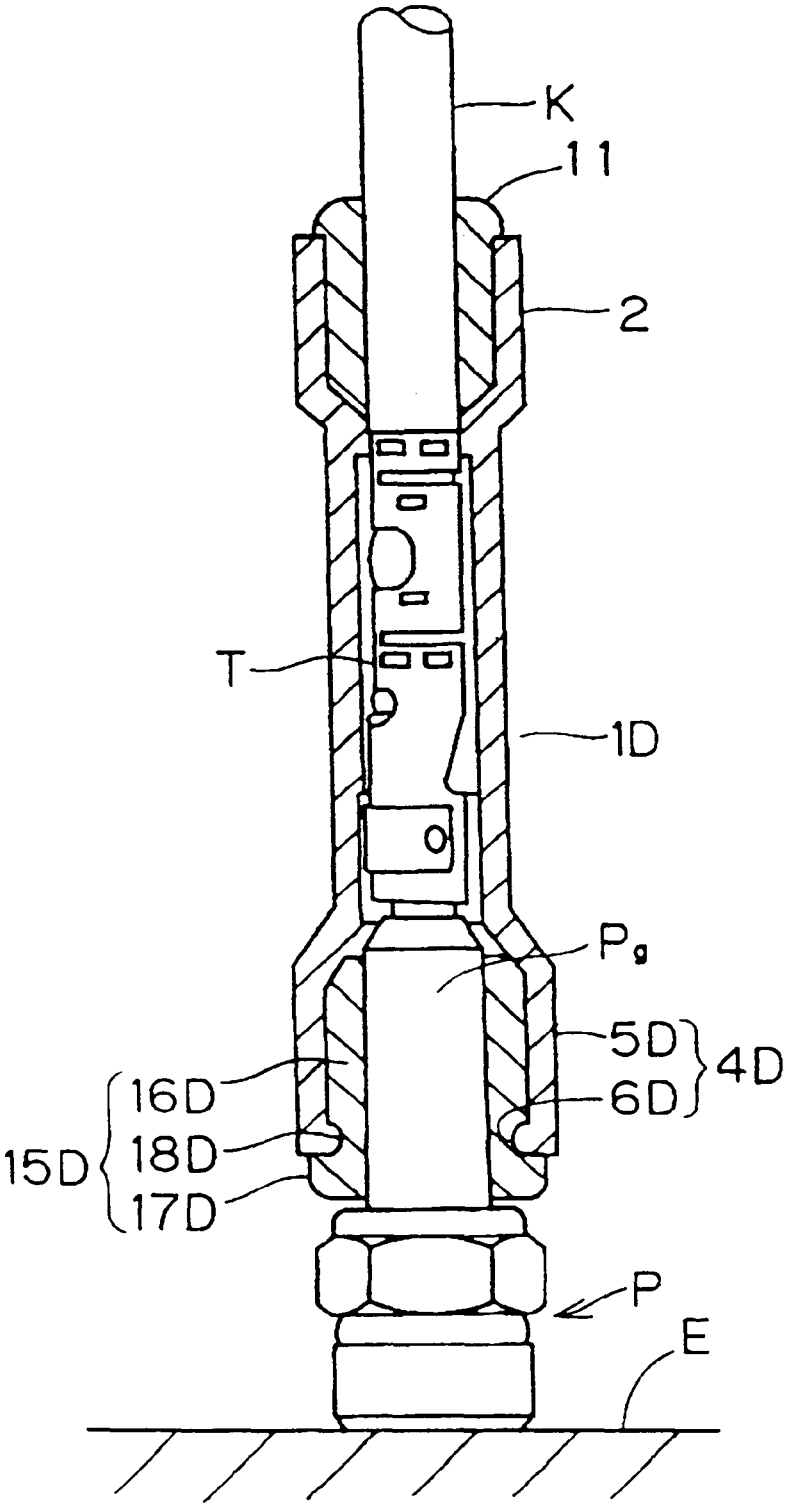
FIG. 4 is a sectional view showing a third modified embodiment of the above connecting part.

The third modified embodiment is configured as shown in FIG. 4, such that the lower end of the plug tube 1D has a slightly larger diameter than the intermediate part in its longitudinal direction, and a projecting rib 6D is formed to project inwardly over the entire inner periphery thereof, by which the second fitting part 4D is formed. On the other hand, the second bushing 15D, which is to be fitted to the second fitting part 4D by insertion into the second diameter enlarged portion 5D, is provided on the lower end of the outer peripheral surface thereof with a projecting flange 17D which projects outward over the entire periphery thereof. Furthermore, a groove 18D is formed along the entire outer peripheral surface of the body 16D, which groove 18D receives and engages the projecting rib 6D on the second fitting part 4D. Thus, when the body 16D is inserted into the second fitting part 4D until the flange 17D comes into contact with the lower end face of the second fitting part 4D, the projecting rib 6D is engaged with the groove 18D, and the second bushing 15D is securely fitted to the second fitting part 4D.

Figure 5:
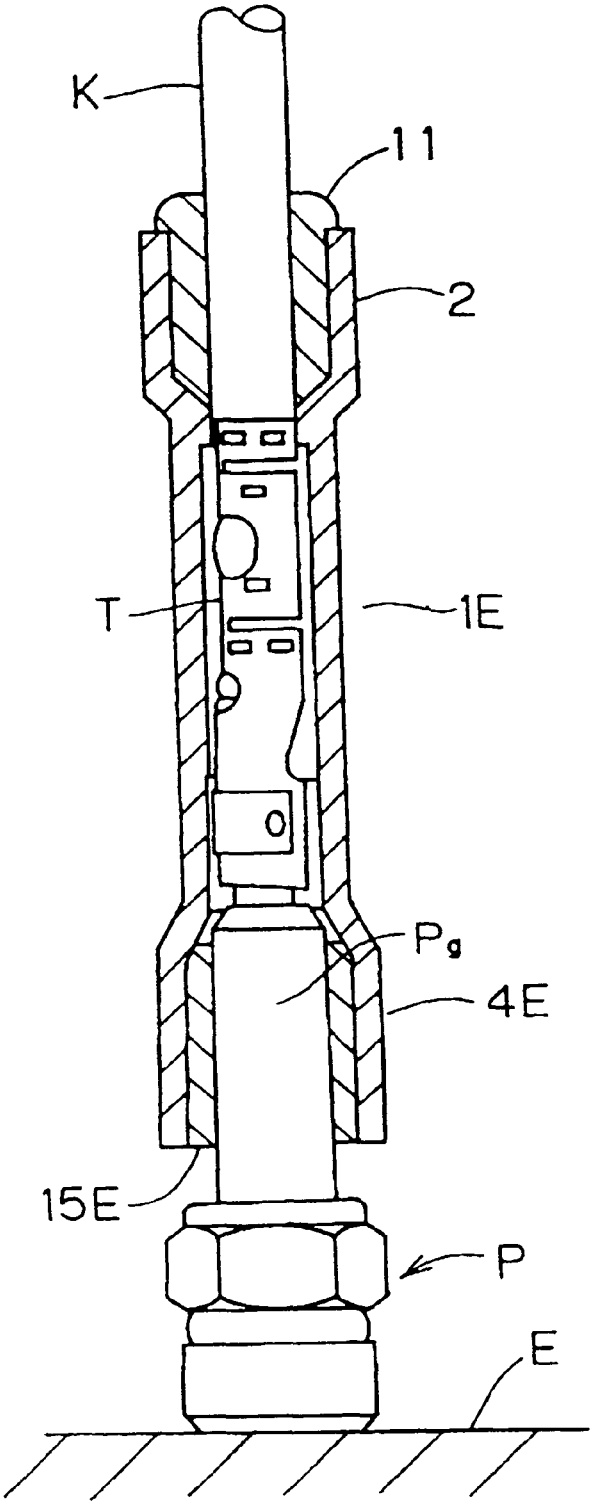
FIG. 5 is a sectional view showing a fourth modified embodiment of the above connecting part.

In this third modified embodiment, when the projecting rib 6D is engaged with the groove 18D, the second bushing 15D is securely fitted to the second fitting part 4D. Furthermore, when the second bushing 15D is fitted over the insulator part Pg of the ignition plug P, the bushing 15D is deformed by being enlarged in diameter by the insulator Pg and the projecting rib 6D is pressed deeper into the groove 18D. Accordingly, in removing the plug tube D from the ignition plug P and the like, sliding of the second bushing 15D out from the plug tube D is prevented. Lastly, the fourth modified embodiment is configured as shown in FIG. 5, such that the lower end of the plug tube 1E has a slightly larger diameter than the middle part in its longitudinal direction, by which the second fitting part 4E is formed. On the other hand, the second bushing 15E to be fitted to the second fitting part 4E is formed to have a short tube-shape having a length to be entirely received by the enlarged diameter part of the second fitting part 4C, with the outer end thereof being positioned generally flush with the lower end of the second fitting, part 4E (as shown in FIG. 5). Thus, when the second bushing 15E is accommodated in the second fitting part 4E, the second bushing 15E is entirely positioned within and fixed to the second fitting part without exposure from the lower end opening of the plug tube 1E.

In this fourth modified embodiment, since the second bushing 15E coterminates with the lower most end of plug tube 1E, it is not exposed from the plug tube 1E, and thermal degradation of the second bushing 15E by heat radiation is prevented.

As described above, according to the structure of the connection between the ignition plug and the ignition cable of the present invention, a high voltage terminal and an ignition plug end terminal are electrically connected in a plug tube by fitting the second bushing over the insulator under the condition where the high voltage terminal is held at a predetermined position in the plug tube with the part of the ignition cable near the high voltage terminal being held by engagement with the first bushing.

Additionally, as the plug tube itself has high heat resistance, unlike the conventional case, there is no necessity to provide an additional heat shielding member, which results in the structure of the connector being compact in size. This permits excellent assembly in a narrow space surrounded by exhaust tubes and the like, enabling more positive electrical connection between the high voltage terminal and the end terminal.

Also, because the plug tube is formed of an electrically non-conductive ceramic material, there is no need to ground the plug tube. Accordingly, contrary to the conventional construction in which the coil spring for grounding interferes with the electrical connection between the connection terminal and the end terminal, the present invention does not necessitate such a coil spring for grounding, and reduces the likelihood of the situation described above to occur, so that a more positive electrical connection between the connection terminal and the end terminal is assured.

Furthermore, since the plug tube is formed of a high hardness ceramic material, in fitting the second bushing 15 at the other end of the plug tube over the insulator part of the ignition plug, moderate feel in engaging them together can be improved, and engagement between the second bushing and the insulator can be sufficiently made. In this respect, electrical connection between the connection terminal and the end terminal is more satisfactorily attained.

Also, when the connector of the present invention is configured such that a projection is formed around the inner peripheral surface of the lower end of the plug tube, and the second bushing is formed with a groove in which the projection can be engaged, and the second bushing is fitted into the lower end of the plug tube. Thus, in removing the plug tube from the ignition plug, slipping of the second bushing out of the plug tube is prevented.

Furthermore, when the configuration of the connector of the present invention is such that the second bushing is fitted entirely within the lower end of the plug tube, thermal degradation of the second bushing is prevented.

Although the invention has been described with reference to particular means, materials and embodiments, it is to be understood that the invention is not limited to the particulars disclosed and extends to all equivalents within the spirit and scope of the claims.

The present disclosure relates to subject matter contained in priority Japanese Application No. JP 10-321878, filed on Nov. 12, 1998, which is herein expressly incorporated by reference in its entirety.

What is claimed is:

1. A connector for connecting an ignition cable to an ignition plug, the ignition plug being mounted to project from an engine body, the plug having an insulator and an end terminal disposed at an upper end of the plug, the ignition cable having a high voltage terminal at one end thereof, said connector comprising:

a plug tube formed of a ceramic material and to have a generally tubular configuration in which a high voltage terminal at the end of the ignition cable can be accommodated, and first and second bushings inserted within first and second ends of said plug tube, respectively, wherein the high voltage terminal is receivable within said plug tube with said first bushing fixedly holding the ignition cable so that the high voltage terminal is located at a predetermined position in said plug tube to engage the end terminal of the ignition plug, and the high voltage terminal and the end terminal are electrically connectable within the plug tube by fitting said second bushing over the insulator such that the high voltage terminal engages the end terminal; and wherein said second end of said plug tube includes a radially inwardly extending peripheral rib, and said second bushing includes a radially outwardly extending peripheral groove to engage with said rib, said second bushing being inserted in said second end of said plug tube so that said rib engages within said groove.

2. The connector for an ignition plug and an ignition cable according to claim 1, wherein at least one of said first and second ends of said plug tube includes a radially enlarged portion that receives a respective one of said first and second bushings.

3. The connector for an ignition plug and an ignition cable according to claim 2, wherein both said first and second ends of said plug tube include said radially enlarged portions.

4. A connector for connecting an ignition cable to an ignition plug, the ignition plug being mounted to project from an engine body, the plug having an insulator and an end terminal disposed at an upper end of the plug, the ignition cable having a high voltage terminal at one end thereof, said connector comprising:

a plug tube formed of a ceramic material and to have a generally tubular configuration in which a high voltage terminal at the end of the ignition cable can be accommodated, and first and second bushings inserted within first and second ends of said plug tube, respectively, wherein the high voltage terminal is receivable within said plug tube with said first bushing fixedly holding the ignition cable so that the high voltage terminal is located at a predetermined position in said plug tube to engage the end terminal of the ignition plug, and the high voltage terminal and the end terminal are electrically connectable within the plug tube by fitting said second bushing over the insulator such that the high voltage terminal engages the end terminal; and wherein said second end of said plug tube includes an outer cylindrical portion forming an axially extending annular groove, and said second bushing includes an axially extending in-turned peripheral flange that interfits within said annular groove.

5. The connector for an ignition plug and an ignition cable according to claim 4, wherein said outer cylindrical portion extends to a position past an outermost end of said second end of said plug tube to cover and protect said second bushing.

6. A connector for connecting an ignition cable to an ignition plug, the ignition plug being mounted to project from an engine body, the plug having an insulator and an end terminal disposed at an upper end of the plug, the ignition cable having a high voltage terminal at one end thereof, said connector comprising:

a plug tube formed of a ceramic material and to have a generally tubular configuration in which a high voltage terminal at the end of the ignition cable can be accommodated, and first and second bushings inserted within first and second ends of said plug tube, respectively, wherein the high voltage terminal is receivable within said plug tube with said first bushing fixedly holding the ignition cable so that the high voltage terminal is located at a predetermined position in said plug tube to engage the end terminal of the ignition plug, and the high voltage terminal and the end terminal are electrically connectable within the plug tube by fitting said second bushing over the insulator such that the high voltage terminal engages the end terminal; and wherein said second end of said plug tube includes a radially outwardly extending peripheral rib, and said second bushing includes an axially extending external flange having a radially inwardly extending peripheral groove that interfits with said peripheral rib.

7. A connector for connecting an ignition cable to an ignition plug, the ignition plug being mounted to project from an engine body, the plug having an insulator and an end terminal disposed at an upper end of the plug, the ignition cable having a high voltage terminal at one end thereof, said connector comprising:

a plug tube formed of a ceramic material and to have a generally tubular configuration in which a high voltage terminal at the end of the ignition cable can be accommodated, and first and second bushings inserted within first and second ends of said plug tube, respectively, wherein the high voltage terminal is receivable within said plug tube with said first bushing fixedly holding the ignition cable so that the high voltage terminal is located at a predetermined position in said plug tube to engage the end terminal of the ignition plug, and the high voltage terminal and the end terminal are electrically connectable within the plug tube by fitting said second bushing over the insulator such that the high voltage terminal engages the end terminal; and wherein an axially outermost end of said second bushing terminates flush with an axially outermost end of said second end of said plug tube.

8. A connector for connecting an ignition cable to an ignition plug, the ignition plug being mounted to an engine body and having an insulator and an end terminal disposed at an upper end thereof projecting from the engine, the ignition cable having a high voltage terminal at one end thereof, said connector comprising:

a plug tube formed of an electrically non-conductive insulating, high heat resistant material and to have a generally tubular configuration in which a high voltage terminal at the end of the ignition cable can be accommodated, and first and second bushings inserted within first and second ends of said plug tube, respectively, wherein the high voltage terminal is receivable within said plug tube with said first bushing fixedly holding the ignition cable so that the high voltage terminal is located at a predetermined position in said plug tube to engage the end terminal of the ignition plug, and the high voltage terminal and the end terminal are electrically connectable within the plug tube by fitting said second bushing over the insulator such that the high voltage terminal engages the end terminal; and wherein said second end of said plug tube includes a radially inwardly extending peripheral rib, and said second bushing includes a radially outwardly extending peripheral groove to engage with said rib, and said second bushing being inserted in said second end of said plug tube so that said rib engages within said groove.

9. A system including the ignition plug and the ignition cable in addition to the connector as recited in claim 8.

10. The connector for an ignition plug and an ignition cable according to claim 8, wherein said insulating material of said plug tube comprises a material having thermal insulating properties to insulate against temperatures above 1000° C.

11. The connector for an ignition plug and an ignition cable according to claim 10, wherein said insulating material comprises a ceramic material.

12. The connector for an ignition plug and an ignition cable according to claim 8, wherein at least one of said first and second ends of said plug tube includes a radially enlarged portion that receives a respective one of said first and second bushings.

13. The connector for an ignition plug and an ignition cable according to claim 12, wherein both said first and second ends of said plug tube include said radially enlarged portions.

14. A connector for connecting an ignition cable to an ignition plug, the ignition plug being mounted to an engine body and having an insulator and an end terminal disposed at an upper end thereof projecting from the engine, the ignition cable having a high voltage terminal at one end thereof, said connector comprising:

a plug tube formed of an electrically non-conductive insulating, high heat resistant material and to have a generally tubular configuration in which a high voltage terminal at the end of the ignition cable can be accommodated, and first and second bushings inserted within first and second ends of said plug tube, respectively, wherein the high voltage terminal is receivable within said plug tube with said first bushing fixedly holding the ignition cable so that the high voltage terminal is located at a predetermined position in said plug tube to engage the end terminal of the ignition plug, and the high voltage terminal and the end terminal are electrically connectable within the plug tube by fitting said second bushing over the insulator such that the high voltage terminal engages the end terminal; and wherein said second end of said plug tube includes an outer cylindrical portion forming an axially extending annular groove, and said second bushing includes an axially extending in-turned peripheral flange that interfits within said annular groove.

15. The connector for an ignition plug and an ignition cable according to claim 14, wherein said outer cylindrical portion extends to a position past an outermost end of said second end of said plug tube to cover and protect said second bushing.

16. The connector for an ignition plug and an ignition cable according to claim 14, wherein said insulating material comprises a ceramic material.

17. A connector for connecting an ignition cable to an ignition plug, the ignition plug being mounted to an engine body and having an insulator and an end terminal disposed at an upper end thereof projecting from the engine, the ignition cable having a high voltage terminal at one end thereof, said connector comprising:

a plug tube formed of an electrically non-conductive insulating, high heat resistant material and to have a generally tubular configuration in which a high voltage terminal at the end of the ignition cable can be accommodated, and first and second bushings inserted within first and second ends of said plug tube, respectively, wherein the high voltage terminal is receivable within said plug tube with said first bushing fixedly holding the ignition cable so that the high voltage terminal is located at a predetermined position in said plug tube to engage the end terminal of the ignition plug, and the high voltage terminal and the end terminal are electrically connectable within the plug tube by fitting said second bushing over the insulator such that the high voltage terminal engages the end terminal; and wherein said second end of said plug tube includes a radially outwardly extending peripheral rib, and said second bushing includes an axially extending external flange having a radially inwardly extending peripheral groove that interfits with said peripheral rib.

18. The connector for an ignition plug and an ignition cable according to claim 17, wherein said insulating material comprises a ceramic material.

19. A connector for connecting an ignition cable to an ignition plug, the ignition plug being mounted to an engine body and having an insulator and an end terminal disposed at an upper end thereof projecting from the engine, the ignition cable having a high voltage terminal at one end thereof, said connector comprising:

a plug tube formed of an electrically non-conductive insulating, high heat resistant material and to have a generally tubular configuration in which a high voltage terminal at the end of the ignition cable can be accommodated, and first and second bushings inserted within first and second ends of said plug tube, respectively, wherein the high voltage terminal is receivable within said plug tube with said first bushing fixedly holding the ignition cable so that the high voltage terminal is located at a predetermined position in said plug tube to engage the end terminal of the ignition plug, and the high voltage terminal and the end terminal are electrically connectable within the plug tube by fitting said second bushing over the insulator such that the high voltage terminal engages the end terminal; and wherein an axially outermost end of said second bushing terminates flush with an axially outermost end of said second end of said plug tube.

20. The connector for an ignition plug and an ignition cable according to claim 19, wherein said insulating material comprises a ceramic material.

* * * * *